United States Patent [19]

Todd et al.

[11] Patent Number: 4,715,087

[45] **Date of Patent: * Dec. 29, 1987**

[54] HIGH SPEED FLOOR BURNISHER

[75] Inventors: Mike J. Todd, Eagan, Minn.; Gary E. Palmer, Roselle, Ill.

[73] Assignee: Hako Minuteman, Inc., Addison, Ill.

[ * ] Notice: The portion of the term of this patent subsequent to Dec. 30, 2003 has been disclaimed.

[21] Appl. No.: 807,679

[22] Filed: Dec. 11, 1985

[51] Int. Cl.[4] ..... B24B 29/00; A47L 11/14; A47L 11/20

[52] U.S. Cl. ..... 15/385; 15/98; 15/230

[58] Field of Search ..... 15/385, 98, 87, 230, 15/320

[56] References Cited

U.S. PATENT DOCUMENTS

| | | | |
|---|---|---|---|
| 1,093,820 | 4/1914 | Beach . | |
| 1,536,615 | 5/1925 | Majusick . | |
| 2,415,372 | 2/1947 | Salt . | |
| 2,893,037 | 7/1959 | Strong | 15/230 X |
| 3,067,549 | 12/1962 | Laverdisse . | |
| 3,183,542 | 5/1965 | Anders | 15/230 X |
| 3,386,122 | 6/1968 | Mathison | 15/230.17 |
| 3,795,932 | 3/1974 | Young | 15/98 |
| 4,000,538 | 1/1977 | Tissier | 15/385 |
| 4,148,110 | 4/1979 | Moen | 15/385 |
| 4,178,654 | 12/1979 | Mitchell . | |
| 4,351,081 | 9/1982 | Tarkinson | 15/230 X |
| 4,365,377 | 12/1982 | Todd et al. | 15/98 |
| 4,441,229 | 4/1984 | Monson | 15/385 |
| 4,485,519 | 12/1984 | Collier | 15/385 |
| 4,541,207 | 9/1985 | Antonson . | |
| 4,589,161 | 5/1986 | Kochte et al. | 15/385 |
| 4,590,635 | 5/1986 | Tucker et al. | 15/98 |
| 4,598,440 | 7/1986 | Wilson . | |
| 4,631,775 | 12/1986 | Palmer . | |
| 4,638,523 | 1/1987 | Todd . | |

FOREIGN PATENT DOCUMENTS

| | | | |
|---|---|---|---|
| 0073725 | 3/1983 | European Pat. Off. . | |
| 1953216 | 4/1971 | Fed. Rep. of Germany . | |
| 2750016 | 5/1978 | Fed. Rep. of Germany . | |
| 1488998 | 6/1967 | France . | |
| 1561379 | 3/1969 | France . | |
| 2016324 | 9/1979 | United Kingdom | 15/98 |

OTHER PUBLICATIONS

Brochure-Borema "Ultra High Speed", by Hawig Machinenfabrik GmbH.

*Primary Examiner*—Chris K. Moore
*Attorney, Agent, or Firm*—Emrich & Dithmar

[57] ABSTRACT

A driver assembly for the burnishing pad of a high speed floor burnishing machine includes a rotatably driven hub having spaced-apart recesses in its outer surface. The hub is fixed to a flexible backing plate having inner and outer depending cylindrical retaining flanges defining a channel in which the burnishing pad is received for attachment to the backing plate by a gripper pad. The inner edge of the burnishing pad is clamped against the gripper pad by an inner clamping cup which is received within the inner retaining flange in an interference fit therewith. The driver assembly is supported on a center caster, the wheel of which is disposed in the clamping cup. The burnishing pad and driver assembly are surrounded by a vacuum shroud which is continuously evacuated by radial air flow generated by the motion of the driver assembly.

22 Claims, 3 Drawing Figures

HIGH SPEED FLOOR BURNISHER

BACKGROUND OF THE INVENTION

The present invention relates to floor polishers or burnishers and, more particularly, to so-called high speed burnishers. As used herein, "high speed" refers to rotary burnishing machines wherein the floor-contacting burnishing pad is rotated at an angular velocity greater than 1,000 revolutions per minute. Typically, such machines may operate at speeds up to 1,800 or 2,000 r.p.m. The present invention is an improvement of the high speed floor burnisher disclosed in the copending U.S. application Ser. No. 787,269, filed Oct. 15, 1985 and entitled "Improvements in High Speed Floor Burnisher".

The floor burnisher disclosed in that application has a driver assembly for the burnishing pad which includes a rotatably driven hub which carries the burnishing pad, the hub and pad being enclosed within a vacuum shroud. The rotating motion of the hub and burnishing pad generates a radial air flow which is directed from beneath the shroud to associated collection means. In that device, the air flow is generated by a plurality of spaced-apart and radially outwardly extending fins or vanes on the hub. But these fins increase the cost of manufacture of the hub and necessitate the use of a shroud which is large enough to encompass the fins.

The invention of the copending application utilizes a flexible backing plate for supporting the burnishing pad which facilitates maintenance of uniform contact of the entire working area of the burnishing pad with the floor. The backing plate has an outer depending retaining flange to prevent radial outward expansion of the burnishing pad. The flange also assists in positioning the burnishing pad.

While the burnishing machine disclosed in the copending application is of the type in which the burnishing pad is coaxial with the drive motor shaft, it is desirable to provide a machine which affords the benefits of that device in a machine of the type which utilizes a rear-mounted motor and a center caster, such as that disclosed in U.S. Pat. No. 4,365,377.

SUMMARY OF THE INVENTION

It is a general object of the present invention to provide a high speed floor burnishing machine and, in particular, a driver assembly therefor, which avoids the disadvantages of prior driver assemblies while affording additional structural and operating advantages.

An important feature of the invention is the provision of a driver assembly of the type set forth which is housed within a vacuum shroud and which employs the air flow created by the rotating pad alone for evacuating the shroud without the use of either an auxiliary vacuum motor or radially projecting vanes or fins on the driver assembly. This permits using a drive motor having the largest ampere rating available for the intended use (for example, 15- or 20-amp, 60-cycle wall outlets) without reserving any of the available capacity for driving an auxiliary motor or otherwise loading the main motor.

Another advantage of the invention is the provision of a driver assembly of the type set forth which permits an accurate centering of an annular burnishing pad on the driver assembly while insuring uniform contact of the entire working surface of the burnishing pad with the floor.

Another feature of the invention is the provision of a driver assembly of the type set forth which is adapted for use with a machine utilizing a supporting caster disposed centrally of the burnishing pad.

Certain of these features are attained by providing in a floor burnisher including a burnishing pad and a motor for rotating the pad at a high speed, an improved driver assembly comprising: circular hub means having an axis and having an annular outer surface with no portion of the hub means projecting outwardly beyond the outer surface, mounting means fixedly securing the pad to the hub means substantially coaxially therewith, means coupling the motor to the hub means for rotation thereof about the axis in engagement with the floor, vacuum shroud means engageable with the floor and cooperating therewith and with the hub means to encompass the pad and form a chamber therearound, and collection means communicating with the chamber, high speed rotation of the pad creating a flow of air from the chamber to the collection means for reducing the pressure beneath the pad without the use of impeller means within the chamber or a separate vacuum motor.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
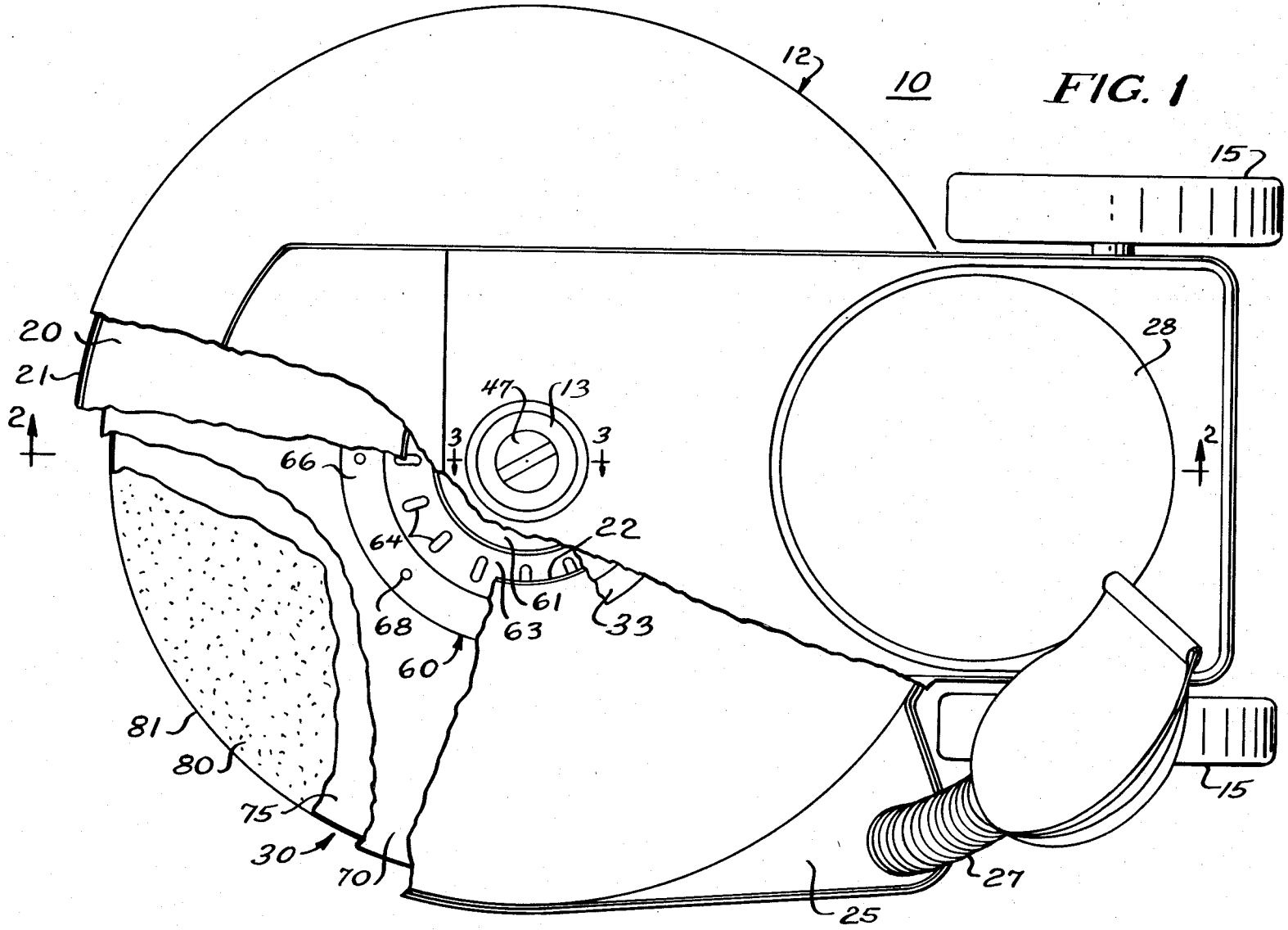
FIG. 1 is a top plan view of a burnishing machine incorporating a driver assembly constructed in accordance with and embodying the features of the present invention, with the portions broken away more clearly to show the internal construction.
Figures 2, 3:
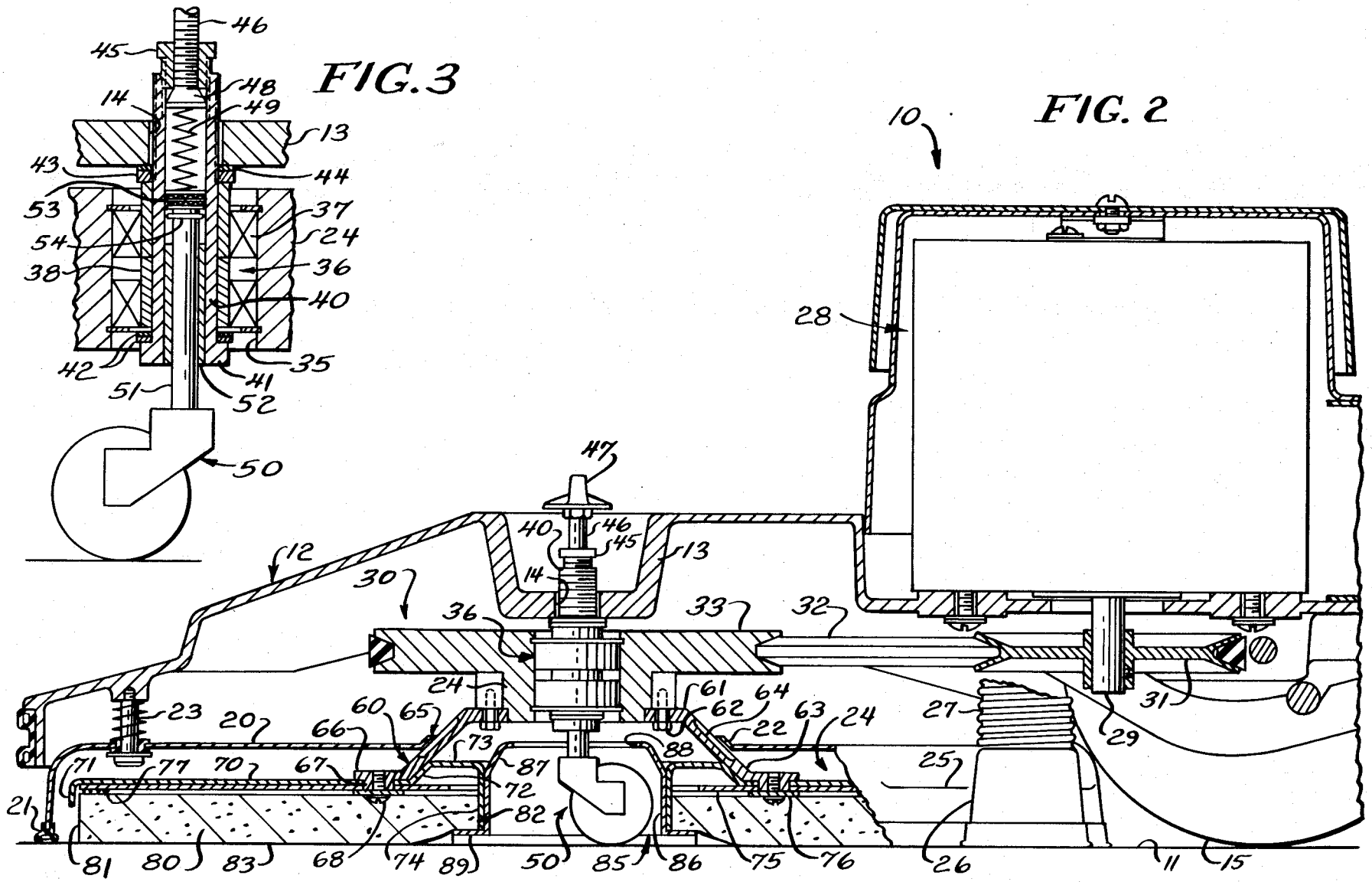
FIG. 2 is an enlarged fragmentary view in vertical section taken along the line 2—2 in FIG. 1.
FIG. 3 is a further enlarged fragmentary view in vertical section taken along the line 3—3 in FIG. 1.

Referring to FIGS. 1 and 2 of the drawings, there is illustrated a high speed floor burnishing machine, generally designated by the numeral 10, for use in polishing or burnishing a floor 11. The machine 10 includes a housing 12 which has a centrally located well or recess 13 in the top portion thereof with a circular aperture 14 therethrough (FIG. 2). The housing 12 is supported for movement along the floor 11 by a pair of coaxial wheels 15 mounted rearwardly of the housing 12 by conventional means which form no part of the present invention. There is also provided a handle (not shown) operatively connected to the housing 12 so that the user of the machine 10 can propel it as desired.

An annular vacuum shroud 20 is suspended beneath the housing 12 and has a circular lower edge provided with a floor seal 21 disposed in use in sealing engagement with the floor 11. The shroud 20 has a frustoconical lip 22 defining an upper edge. Preferably, the vacuum shroud 20 is suspended from the housing 12 by a plurality of spring mounts 23, which may be of the type disclosed in the aforementioned copending application Ser. No. 787,269, so that the vacuum shroud 20 is mounted to the housing 12 for independent movement relative thereto. The vacuum shroud 20 defines therebeneath a chamber 24 and is provided adjacent to the rear end thereof with a lateral extension 25 and an upwardly extending discharge portion 26 which defines a discharge opening communicating with a collector conduit 27, which in turn may communicate with suitable collection apparatus such as a collection bag.

Mounted on the housing 12 is an electric motor 28 having an output shaft 29 extending substantially vertically downwardly therefrom for coupling to a driver assembly, generally designated by the number 30, constructed in accordance with and embodying the features of the present invention. The driver assembly 30 includes a pulley 31 which is fixed on the shaft 29 and engages a drive belt 32, which is in turn engaged with a pulley 33 centered beneath the well 13 coaxially with the aperture 14 therein. Referring also to FIG. 3, the pulley 33 has a central hub portion 34 defining a cylindrical axial bore 35 in which is received a bearing 36, having an outer race 37 fixedly secured to the hub portion 34 and an inner race 38.

An elongated tubular sleeve 40 is fitted coaxially through the inner race 38 and is provided at its lower end with a radially outwardly extending annular flange 41. The bearing 36 is supported on the flange 41, spacers 42 being provided to accurately position the bearing 36 at the desired elevation. The upper end of the sleeve 40 projects upwardly from the bearing 36 and is externally threaded for threaded engagement with a nut 43, securely to hold the bearing 36 against the flange 41. One or more additional spacers 44 may be provided on the nut 43 to separate it from the well 13. The upper end of the sleeve 40 extends coaxially through the aperture 14 in the center well 13 and is internally threaded for threadedly receiving therein a plug 45. The plug 45 has an internally threaded axial bore therethrough in which is engaged an adjustment screw 46, provided at the upper end with a handle knob 47 and having a wide lower end 48 with an outer diameter very slightly less than the inner diameter of the sleeve 40. A helical compression spring 49 is disposed in the sleeve 40 with its upper end bearing against the lower end 48 of the adjustment screw 46.

The driver assembly 30 is supported on a caster 50 having a pivot shaft 51 which extends upwardly through a bearing 52 which is press fitted in the lower end of the sleeve 40. The upper end of the shaft 51 engages a bearing 53 which in turn bears against the lower end of the spring 49. A lock ring 54 may be seated on the upper end of the shaft 51 to preclude withdrawal of the shaft 51 from the bearing 52.

The driver assembly 30 also includes an annular hub member 60 which has a flat annular top wall 61 fixedly secured, as by fasteners 62, to the bottom of the hub portion 34 of the pulley 33 at circumferentially spaced-apart locations therearound. Integral with the top wall 61 is a downwardly and outwardly diverging frustoconical side wall 63, provided in its outer surface with a plurality of circumferentially spaced-apart elongated recesses 64. The frustoconical side wall 63 is dimensioned to fit within the frustoconical lip 22 of the vacuum shroud 20 coaxially therewith. The frustoconical lip 22 and the frustoconical side wall 63 are radially spaced apart a slight distance and cooperate to define therebetween an annular air inlet passage 65 for admitting air to the chamber 24 beneath the vacuum shroud 20. Integral with the frustoconical side wall 63 at the lower end thereof and extending radially outwardly therefrom is an annular attachment flange 66, provided with a plurality of circumferentially spaced-apart lugs 67 with which fasteners 68 are adapted to be threadedly engaged.

The lugs 67 are respectively received through complementary openings in a flat annular backing plate 70, provided at its outer periphery with a depending cylindrical outer retaining flange 71. Integral with the inner edge of the backing plate 70 is an upwardly converging frustoconical portion 72 which is disposed in use along the inner surface of the frustoconical side wall 63 of the hub member 60 coaxially therewith. The frustoconical portion 72 is integral at its upper end with a radially inwardly extending annular upper wall 73, which is in turn integral at its inner edge with a depending cylindrical inner retaining flange 74.

Disposed against the underside of the backing plate 70 is an annular gripping pad 75. The lugs 67 of the hub member 60 are respectively received through complementary openings in the gripping pad 75. The fasteners 68 respectively hold clamping washers 76 against the gripping pad 75 for cooperation with the backing plate 70 to securely clamp the gripping pad 75 therebetween. Preferably, the gripping pad 75 is of the type disclosed in the aforementioned copending application Ser. No. 787,269, being provided on its lower surface with a plurality of gripping members in the form of hooks, which are located uniformly throughout the lower surface of the gripping pad 75, some of these hooks being seen at 77 in FIG. 2.

Disposed beneath the gripping pad 75 and engaged and held by the hooks 77 thereof is an annular burnishing pad 80, having a cylindrical outer edge 81 and a cylindrical inner edge 82 and an annular bottom or floor-engaging surface 83. The burnishing pad 80 is compressible in use, preferably being formed of a loosely woven synthetic or natural fiber, the fibers being connected by adhesive or physical interconnection means. In use, it will be appreciated that the inner and outer retaining flanges 74 and 71 of the backing plate 70 cooperate to define therebetween an annular channel in which the burnishing pad 80 is received. In this regard, it is a significant aspect of the present invention that the inner retaining flange 74 is dimensioned to fit snugly within the central opening of the burnishing pad 80 for accurate centering thereof. While the outer retaining flange 71 serves to assist in this centering function, it serves primarily to prevent the pad 80 from expanding radially when it is rotated at high speed. Preferably, the best results are obtained if the outer retaining flange 71 extends to encompass at least one half the depth of the burnishing pad 80 under normal operating conditions (i.e., in full contact pads, after the pad 80 is evacuated and atmospheric pressure causes the driver assembly 30 to compress the pad 80).

A clamping cup 85, which may be of unitary, one-piece construction, is received telescopically in the cylindrical inner retaining flange 74. More particularly, the clamping cup 85 has a cylindrical side wall 86 which is friction or interference fitted in the inner retaining wall 74, and is provided at its upper end with an end wall 87 having a circular aperture 88 therein for accommodating passage of the caster shaft 51 therethrough. The side wall 86 is integral at its lower end with a radially outwardly extending annular clamping flange 89 which is disposed for firm engagement with the bottom surface 83 of the burnishing pad 80 around the entire circumference of the inner edge 82 thereof, for cooperation with the gripping pad 75 securely to clamp the inner edge of the burnishing pad 80 therebetween.

In use, the backing plate 70 adds stiffness and support to the burnishing pad 80, but does not make it absolutely rigid. Thus, the pad 80 is able to continue to conform to the contour of the surface of the floor 11 being burnished during operation. Yet, the stiffness of the backing plate 70 is sufficient to enhance the "full contact" of the burnishing pad 80 with the floor 11. More particularly, when the pad driver assembly 30 is driven at high speed, as defined above, the backing plate 70 becomes even stiffer than it is at rest. This has the effect of not only increasing the resistance of the burnishing pad 80 to curling up at the outer peripheral edges, but it also has the effect of applying a more uniform distribution of downward force to the pad 80 in the area where the speed of the pad 80 is greatest and, therefore, the burnishing is most effective. Preferably, the backing plate 70 is of unitary, one-piece construction and may be molded of a suitable material, such as ABS plastic.

When the hub member 60 is rotated, it operates to create a radially outward air flow pattern, this flow being facilitated by the recesses 64 which enhance a turbine-like action by the hub member 60. This radial air flow pattern causes air to flow inwardly through the inlet passage 65, outwardly across and above the backing plate 70 beneath the vacuum shroud 20, and then into the exhaust extension 25. This air flow pattern serves to entrain all dust or particles created by the high-speed burnishing action, and these entrained particles are forced under action of the air flow through the collector conduit 27 into an associated collection receptacle or filter, so they do not enter the atmosphere. The driver assembly 30 and the burnishing pad 80 also serve to evacuate air from under the pad 80 in a known manner, so that atmospheric pressure will act uniformly downwardly on the driver assembly 30 to force the pad 80 into full circumferential engagement with the floor 11.

In use, it will be appreciated that the caster is designed to roll along the floor 11 in supporting relationship with the driver assembly 30. As the burnishing machine 10 is maneuvered by its operator and the front edge of the housing 12 is tilted downwardly, or the caster rolls over variations in the contour of the floor 11, the spring 49 will be compressed to permit the caster 50 to move upwardly with respect to the driver assembly 30. The burnishing pad 80 will be compressed to accomodate this upward movement of the caster 50. In response to the spring compression, however, the driver assembly 30 and the housing 12 are urged back upwardly immediately to a position wherein the burnishing pad 80 is no longer compressed.

It is a significant aspect of the present invention that the center caster 50 serves to assist in supporting the weight of the housing 12 and motor 28 so that weight is not borne directly by the pad 80. This added support, together with the flexible backing plate 70 serves effectively to prevent unwanted curling of the outer edges of the pad 80 and also serves to minimize the resistance to rotation of the pad 80 so as to maintain it in desired light burnishing contact with the floor 11.

From the foregoing, it can be seen that there has been provided an improved pad driver assembly for a floor burnishing machine which permits an evacuating air flow under the vacuum shroud without the use of an auxiliary vacuum motor or impeller fins, which provides for accurate centering of the burnishing pad on the driver assembly and secure clamping thereof, and which is adapted for use with a center caster.

We claim:

1. A high speed floor burnisher comprising a housing adapted for movement along a floor; a vacuum shroud carried by said housing and defining a lower edge for sealing with said floor; means for resiliently mounting said shroud to said housing to maintain said seal with said floor during use; a motor carried by said housing; and a pad assembly beneath said shroud and driven at high rotary speed by said motor; said shroud forming a chamber above and about the sides of said pad assembly; said pad assembly including: a circular hub having an axis and having an outer surface; a burnishing pad; second mounting means fixedly securing said pad to said hub substantially coaxially therewith; means coupling the motor to drive said hub; collection means communicating with said chamber; means connected to said pad assembly and forming a plurality of recesses extending from the location above said shroud, downwardly and outwardly beneath said shroud into said chamber for introducing make up air beneath said shroud and near the center thereof whereby high speed rotation of the pad assembly creates a flow of air into said chamber at a central part thereof, at least some air flowing outwardly in said chamber over said pad assembly to entrain particles therein and to deliver said entrained particles to said collection means.

2. The apparatus of claim 1, wherein said vacuum shroud is spaced from said hub and cooperates therewith to define therebetween a narrow annular air inlet passage to said chamber; said air passage and said recesses providing said means for introducing make up air.

3. The apparatus of claim 1, wherein the pad has a central aperture therethrough defining an inner edge thereof.

4. The apparatus of claim 3, wherein said mounting means further includes means for securely gripping the pad along the inner edge thereof.

5. The apparatus of claim 1, wherein said second mounting means includes pad gripper means attached to said hub and extending radially outwardly thereof and overlying the pad in gripping engagement therewith.

6. The apparatus of claim 1, wherein said hub extends through the upper center of said shroud and include said plurality of recesses in the form of circumferentially spaced-apart recesses in said outer surface to promote the flow of air from the center of said shroud into the center of said chamber.

7. A high speed burnishing pad and driver assembly comprising: a flexible annular backing member having two integral depending retainer flanges at radially spaced apart locations thereon and cooperating to define an annular channel therebetween, an annular burnishing pad having inner and outer edges and being receivable in said channel in a mounting position with said inner and outer edges being respectively disposed immediately adjacent to said flanges, and mounting means for securely holding said pad in its mounting position against said backing plate, said retainer flanges serving accurately to center said burnishing pad and the outer one of said flanges serving to restrain the outward movement of the outer edge of said pad under high speed operation.

8. The assembly of claim 7, wherein said retainer flanges are unitary with said backing member.

9. The assembly of claim 7, wherein said backing member has circular inner and outer edges, said retainer flanges being respectively disposed along said inner and outer edges and being substantially cylindrical in shape.

10. The assembly of claim 7, wherein said mounting means includes means cooperating with said backing member securely to clamp said pad along the inner edge thereof.

11. The assembly of claim 10, wherein the inner one of said retainer flanges is substantially cylindrical in shape, said clamping means having a cylindrical wall disposable within said inner retainer flange in interference fit therewith, and a clamping flange extending radially outwardly from said cylindrical wall at the lower edge thereof for engagement with the underside of the pad.

12. The assembly of claim 7, and further comprising hub means secured to said backing member centrally thereof and defining a frustoconical inner surface, said backing member having a frustoconical portion disposed in nesting engagement with said frustoconical surface of said hub means.

13. In a floor burnisher including a burnishing pad having a peripheral outer edge and having a central aperture therethrough defining an inner edge and a motor for rotating a pad at a high speed, an improved driver assembly comprising: hub means coupled to the motor for rotation thereby about a central axis, a flexible backing plate attached to said hub means and extending radially outwardly thereof and overlying the pad, means coupling the pad to said backing plate for support thereby and rotation therewith, outer peripheral retaining flange means depending from said backing plate immediately adjacent to the outer edge of the pad and at least partially encompassing the pad, and a caster disposed in the aperture of said pad and rotatably coupled to said hub means in supporting relationship therewith.

14. The driver assembly of claim 13, and further comprising: inner retaining flange means depending from said backing plate immediately adjacent to the inner edge of the pad and cooperating with said outer peripheral retaining flange means for centering the pad therebetween.

15. The driver assembly of claim 14, wherein said inner and outer retaining flange means are unitary with said backing plate.

16. The driver assembly of claim 14, wherein said inner retaining flange means includes a cylindrical flange, and further comprising clamp means having a cylindrical wall receivable coaxially within said inner retaining flange in interference fit therewith, and a clamping flange extending radially outwardly from said cylindrical wall for clamping engagement with the underside of the pad.

17. The driver assembly of claim 13, wherein said coupling means includes means cooperating with said backing plate for clamping the pad along the inner edge thereof.

18. The driver assembly of claim 13, and further comprising vacuum shroud means engageable with the floor and cooperating therewith and with said hub means to encompass the pad and form a chamber therearound, said hub means defining a plurality of recesses extending downwardly and outwardly through a central opening in said shroud means, and collection means communicating with said chamber, high speed rotation of the pad creating a flow of air from said chamber to said collection means for reducing the pressure beneath the pad.

19. The driver assembly of claim 18, wherein said shroud means cooperates with said hub to define therebetween a narrow annular air inlet passage for admitting air to said chamber.

20. In a floor burnisher including a frame, a motor carried by the frame and having a shaft rotating at high speed, a burnishing pad, and a pad driver assembly coupling the motor shaft to the pad for effecting high speed rotation thereof, the improvement comprising: shroud means carried by the frame and encompassing the pad and the pad driver assembly for forming a chamber therearound, air flow means for establishing in said chamber a radially outwardly directed air flow to entrain particles generated by the burnishing action, and collection means for receiving said air and said entrained particles, said shroud means having an inlet air passage therein centrally thereof for permitting make-up air to flow into the central portion of said chamber for establishing said air flow in said chamber.

21. The floor burnisher of claim 20, wherein the burnishing pad has a central aperture therethrough, and further comprising a caster disposed in the central aperture of the pad and coupled to the pad driver assembly in supporting relationship therewith.

22. The floor burnisher of claim 20, and wherein said air flow means further comprising means on the pad driver assembly disposed adjacent to said inlet opening in said shroud means and defining a plurality of recesses extending from a location above said inlet opening downwardly and radially outwardly for generating said air flow in said chamber.

* * * * *